United States Patent [19]

Crumby

[11] 4,370,755

[45] Feb. 1, 1983

[54] COMBINATION PONCHO AND CUSHION

[76] Inventor: John T. Crumby, 206 Scenic Dr., Oak Ridge, Tenn. 37830

[21] Appl. No.: 169,679

[22] Filed: Jul. 17, 1980

Related U.S. Application Data

[63] Continuation-in-part of Ser. No. 67,110, Aug. 14, 1979, abandoned.

[51] Int. Cl.[3] ..... A41D 3/08

[52] U.S. Cl. ..... 2/88; 2/84; 2/DIG. 3

[58] Field of Search ..... 2/88, 89, 84, 93, 94, 2/69, 87, DIG. 3, 24, 2

[56] References Cited

U.S. PATENT DOCUMENTS

| | | | |
|---|---|---|---|
| 1,329,777 | 2/1920 | Kriger | 2/87 |
| 1,468,072 | 9/1923 | Ogle | 2/DIG. 3 |
| 2,331,289 | 3/1953 | Herrington | 2/84 |
| 2,673,349 | 3/1954 | Key | 2/DIG. 3 |
| 3,185,362 | 5/1965 | Wakefield | 2/24 |
| 3,522,612 | 8/1970 | Palmer | 2/84 |
| 3,665,518 | 5/1972 | Leadford | 2/88 |
| 3,781,916 | 1/1974 | Vitol | 2/88 |
| 3,945,042 | 3/1976 | Lobo | 2/2 |
| 3,995,320 | 12/1976 | Zaputo | 2/2 |

FOREIGN PATENT DOCUMENTS

| | | | |
|---|---|---|---|
| 2054674 | 11/1970 | Fed. Rep. of Germany | 2/84 |
| 2722816 | 11/1978 | Fed. Rep. of Germany | 2/94 |
| 652828 | 5/1951 | United Kingdom | 2/94 |

*Primary Examiner*—H. Hampton Hunter

*Attorney, Agent, or Firm*—Scrivener, Clarke, Scrivener and Johnson

[57] ABSTRACT

The disclosure is of a poncho for human use having an enclosed area at the center of the rear panel which may be inflated to form a cushion on which the wearer sits.

1 Claim, 3 Drawing Figures

COMBINATION PONCHO AND CUSHION

RELATION TO OTHER CASES

This application is a continuation-in-part of my copending application Ser. No. 67,110, filed Aug. 14, 1979, for Combination Garment and Cushion and now abandoned.

SUMMARY OF THE INVENTION

The invention provides a poncho having a separate preferably rectangular piece of the same fabric as the garment attached to the interior of the rear panel of the poncho at the center thereof, forming an enclosed pocket which may be inflated to form a cushion for the seated wearer.

DESCRIPTION OF THE INVENTION

Figure 1:
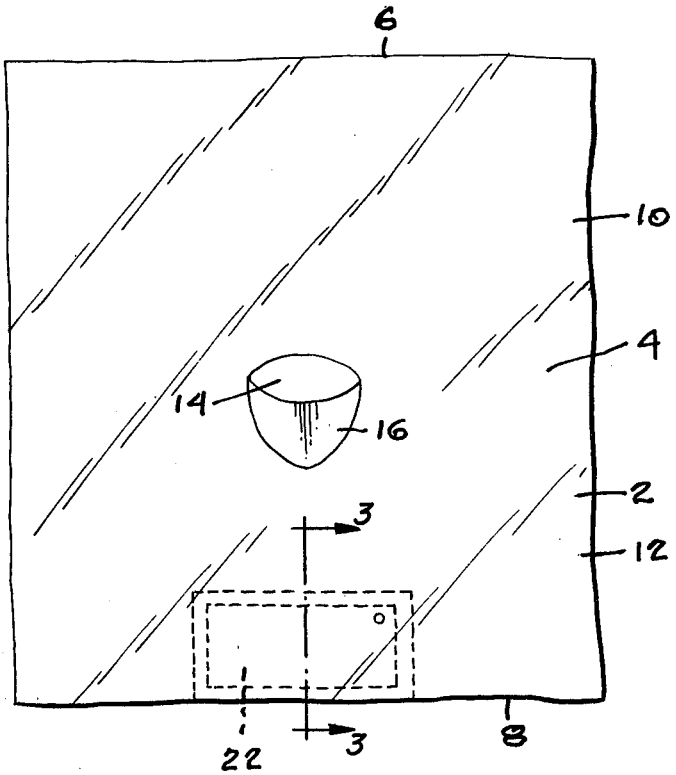
FIG. 1 is a plan view of the poncho when spread out.
Figure 2:
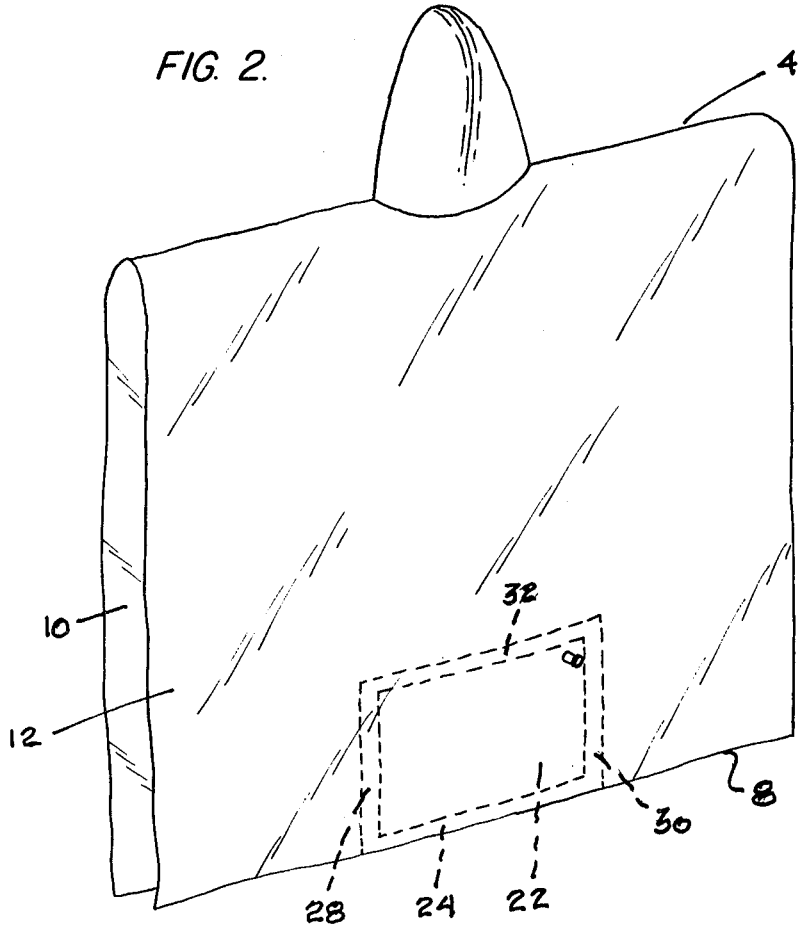
FIG. 2 shows the poncho in the form it takes when worn.
Figure 3:
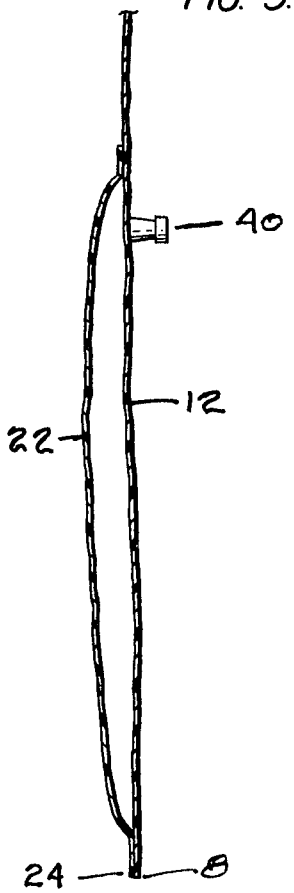
FIG. 3 is a sectional view taken on line 3—3 of FIG. 2.

The poncho for human use provided by the invention comprises a flat single ply sheet 2 or waterproof material which is folded along a transverse line 4 midway between its end edges 6, 8 to form a front panel 10 and a rear panel 12. At the central part of the transverse fold line 4 the poncho is provided with an opening 14 through which the head of the wearer is passed, and a hood 16 is attached along the edge of the opening 14 and extends upwardly from the transverse fold line 4 to provide a cover for the head of the wearer. It will be understood that when the garment is worn the end parts of the transverse fold line 4, on either side of the hood 16, will rest on the shoulders of the wearer with the panels 10, 12 depending at the front and rear of the body. It will also be understood that the sheet from which the garment is made may be of any length, and that the transverse line 4 may be positioned at any part of the length of the sheet, so that the front and rear panels 10, 12 may be of any desired length and may be the same length or different lengths, provided only that the rear panel is of such length that when the garment is worn the lower part of that panel is below the buttocks of the wearer a sufficient distance that the wearer may comfortably sit on such lower part.

At and above the lower edge 8 of the rear panel 12, and at and adjacent the center thereof, a second single ply sheet 22 of waterproof material of rectangular shape is attached to the inner surface of the rear panel with its one edge 24 coinciding with the lower edge 8 of the rear panel, its side edges 28, 30 extending upwardly from the ends of the edge 22 and its upper edge 32 parallel and spaced from the edges 8, 24. This supplemental sheet is connected to the rear panel along its edges 24, 28, 30, 32 by heat sealing or other suitable means, thereby forming an enclosed pocket. The area of the sheet 22 within the boundaries of its four edges is larger than the area defined by the edges whereby the pocket may be enlarged by inflation. A conventional inlet tube and valve 40 may be provided for inflation of the pocket.

The poncho provided by the invention may be folded in such a way that all of the garment outside the inflatable pocket is disposed within the outlines of the pocket, whereby the folded poncho forms a stable, unitary package which may be used itself as a cushion with or without inflation. If used in this way as a cushion the poncho may be unfolded when needed and the pocket inflated, if not already inflated, and after being put on will continue to provide a cushion for the wearer.

I claim:

1. A combination poncho and seating cushion for human use, comprising a rectangular sheet of single ply waterproof material having side edges and transverse edges and having an opening positioned substantially midway between the side and transverse edges for the reception and passage of the head of the wearer, the poncho being adapted and constructed to form front and rear panels when folded about a line extending transversely from the lead receiving opening with the fold line resting on the shoulders of the wearer, the rear panel being of such length that when the poncho is worn with the wearer in a standing position the lower edge of the rear panel is adjacent and below the buttocks of the wearer, a substantially rectangular sheet of single ply waterproof material attached about its periphery to the inner surface of the rear panel of the poncho with one of its edges substantially aligned with the lower edge of the rear panel at the center thereof, said attached sheet being larger in areas than the outline of its edges, thereby forming an inflatable enclosed pocket at and adjacent the buttocks of the wearer in a standing or seated position, and means for inflating the pocket to form a cushion.

* * * * *